US012203270B2

(12) United States Patent
De Frene et al.

(10) Patent No.: US 12,203,270 B2
(45) Date of Patent: Jan. 21, 2025

(54) TERRACE CANOPY

(71) Applicant: RENSON SUNPROTECTION-SCREENS, Waregem (BE)

(72) Inventors: Joost De Frene, Waregem (BE); Kristof Lemiegre, Gentbrugge (BE); Lennart De Meulemeester, Ledeberg (BE); Pieter Brabant, Rumbeke (BE); Stijn Colpaert, Oudenaarde (BE); Thomas De Rycke, Ghent (BE)

(73) Assignee: RENSON SUNPROTECTION-SCREENS (BE)

( * ) Notice: Subject to any disclaimer, the term of this patent is extended or adjusted under 35 U.S.C. 154(b) by 162 days.

(21) Appl. No.: 17/919,838

(22) PCT Filed: Apr. 21, 2021

(86) PCT No.: PCT/IB2021/053273
§ 371 (c)(1),
(2) Date: Oct. 19, 2022

(87) PCT Pub. No.: WO2021/214671
PCT Pub. Date: Oct. 28, 2021

(65) Prior Publication Data

US 2023/0193631 A1 Jun. 22, 2023

(30) Foreign Application Priority Data

Apr. 21, 2020 (BE) ..... 2020/5264

(51) Int. Cl.
*E04D 13/064* (2006.01)
*E04D 13/08* (2006.01)
*E04F 10/00* (2006.01)

(52) U.S. Cl.
CPC ..... *E04D 13/0643* (2013.01); *E04D 13/08* (2013.01); *E04F 10/00* (2013.01); *E04D 2013/0893* (2013.01)

(58) Field of Classification Search
CPC ..... E04C 3/07; E04C 2003/0413; E04C 2003/0439; E04C 2003/0465;
(Continued)

(56) References Cited

U.S. PATENT DOCUMENTS 2,970,676 A * 2/1961 Maciunas ..... E04B 1/24 52/262
3,542,407 A * 11/1970 Brown ..... F16B 12/40 403/174

(Continued)

FOREIGN PATENT DOCUMENTS

BE 1021793 B1 1/2016
EP 3135837 A1 3/2017

(Continued)

OTHER PUBLICATIONS

International Search Report and Written Opinion for PCT Application No. PCT/IB2021/053273, dated Aug. 25, 2021, pp. 1-12.

(Continued)

*Primary Examiner* — Gisele D Ford
(74) *Attorney, Agent, or Firm* — Dickinson Wright PLLC

(57) ABSTRACT

Disclosed is a terrace canopy constructed from a support pillar provided with a cavity for discharging precipitation incident on the terrace canopy towards a ground surface and at least two beams, each of which provided with a gutter for discharging precipitation incident on the terrace canopy to an end face of the beam. A headboard is attached to the end face of the beams. A corner connection element is fixedly attached to the support pillar and to the headboards. The corner connection element is provided with one, or prefer- (Continued)

ably, a plurality of support legs extending towards the support pillar.

20 Claims, 10 Drawing Sheets

(58) Field of Classification Search
CPC ..... E04D 2013/0893; E04D 13/08; E04D 13/064; E04F 10/0685; E04F 10/02; E04F 10/06; E04H 6/025; E04H 15/58; E04B 2001/2409; E04B 2001/2451; E06B 9/42; F16B 7/0473
See application file for complete search history.

(56) References Cited

U.S. PATENT DOCUMENTS 4,027,987 A * 6/1977 Berkowitz ..... F16B 7/0446 403/295
4,100,703 A * 7/1978 Sickler ..... E04B 7/00 52/16
4,562,681 A * 1/1986 Smith ..... E04B 1/1912 403/171
5,435,110 A * 7/1995 Stol ..... B62D 29/008 403/171
6,128,876 A * 10/2000 Nitschke ..... E04B 2/7433 403/174
6,446,394 B1 * 9/2002 Finke ..... E05D 15/0652 49/404
8,051,868 B2 * 11/2011 Whitlow ..... E04H 15/644 52/63
9,422,715 B1 * 8/2016 Selzer ..... E04D 11/00
9,801,462 B2 * 10/2017 Chang ..... A47B 13/06
10,676,936 B2 * 6/2020 Lemiegre ..... E04F 10/00
11,149,438 B2 * 10/2021 Torman ..... E04F 10/10
11,326,349 B2 * 5/2022 Jackson ..... E04D 13/0325
11,686,101 B2 * 6/2023 Liang ..... H02S 20/10 160/188
11,725,390 B2 * 8/2023 Jackson ..... E04F 10/10 160/62
11,795,698 B2 * 10/2023 Jackson ..... E04F 10/10
11,834,837 B2 * 12/2023 Wang ..... E04F 10/10
2013/0291438 A1 * 11/2013 Selzer ..... E04B 7/163 49/82.1
2014/0175240 A1 * 6/2014 Selzer ..... E04B 7/163 49/82.1
2016/0298332 A1 * 10/2016 Veys ..... E04C 3/32
2016/0333587 A1 * 11/2016 Veys ..... E04F 10/0685
2018/0127982 A1 * 5/2018 Lemiegre ..... E04F 10/00
2019/0169871 A1 * 6/2019 McKibben ..... H02S 20/23
2019/0191872 A1 * 6/2019 Dreher ..... E04B 2/7437
2019/0249700 A1 * 8/2019 Deng ..... F16B 7/0473
2020/0340299 A1 * 10/2020 Snader ..... E06B 9/42
2020/0370299 A1 * 11/2020 Shan ..... E04F 10/10
2021/0214948 A1 * 7/2021 Jackson ..... E04D 13/064
2022/0127905 A1 * 4/2022 Cortvriendt ..... E06B 9/42

FOREIGN PATENT DOCUMENTS

EP 3587697 A1 1/2020
JP 200927319 A 12/2009
WO 2015104675 A1 7/2015
WO 2019053523 A1 3/2019

OTHER PUBLICATIONS

Notification of Refusal for JP Application No. IP2022/315, dated Nov. 12, 2024, 6 pages.
English Translation of Notification of Refusal for JP Application No. IP2022/315, dated Nov. 12, 2024, 4 pages.

* cited by examiner

TERRACE CANOPY

CROSS-REFERENCE TO RELATED APPLICATION(S)

This present application is a national stage application of International Patent Application No. PCT/IB2021/053273, filed Apr. 21, 2021, which claims priority to Belgium Patent Application No. 2020/5264, filed Apr. 21, 2020, the disclosures of which are hereby incorporated by reference in their entireties.

TECHNICAL FIELD

The present invention relates to a terrace canopy.

STATE OF THE ART

Such terrace canopies are usually set up to screen off or clear an outdoor area. For instance, such screen devices are often set up near houses, restaurants, shops, etc. to screen off an outdoor terrace or the like from sunlight, precipitation and/or wind, or conversely, to temporarily allow in sunlight. These terrace canopies can be implemented, for example, in the form of awnings, pergolas, verandas, carports, a pavilion, etc.

Such a terrace canopy typically comprises a roof frame that is at least partially supported by columns. Exceptionally, the roof frame may also be supported by another roof construction. The roof frame is generally constructed of several beams that are composed into one or more frames into which a roof infill can be attached. The beams themselves are often a composition of a plurality of individual profiles. Such a roof frame is typically supported by four (or more) columns between which a wall infill may be provided. Likewise, less columns may be used in case the roof frame is supported by other structures, such as a wall of an already existing structure.

The roof infill may be stationary or movable, for example, a retractable roof. The roof infill of a retractable roof may, for instance, consist of a rollable cloth or screen, slats that rotate around their axis, or of segments that can slide over each other. The segments may be panels that are partly made of (laminated) glass or plastic, such as PC or PMMA. Depending on the choice of material, the light transmission and robustness of the roof may be adjusted to the desired application. The wall infill can also be stationary or movable. Examples are a rollable cloth or screen or movable, i.e. slidable or foldable, panels.

Furthermore, various types of columns have already been developed that also include other functions in addition to their general support function. For example, the columns may be adapted to also provide supply cables to electrical equipment and/or to include drainage tubes for discharging precipitation and/or to comprise guide profiles for a screen. Preferably, the column should be able to encompass all of the abovementioned functions and also be finished on the outside as aesthetically as possible.

BE 2014/0015 discloses a terrace canopy constructed of columns and beams. In particular, the terrace canopy comprises a support pillar provided with a cavity for discharging precipitation incident on the terrace canopy towards a ground surface and at least two beams, each of which provided with an internal gutter for discharging precipitation incident on the terrace canopy to an end face of the beam. Headboards are used to connect the beams to the support pillar. In particular, a headboard is provided per beam which forms the connection between each beam and the support pillar. Specifically, the integrally formed headboard comprises an upper part which is fixed by means of screws to an end face of the beam, in particular by screwing the screws into screw channels in the beams provided for this purpose. A pin extends downwardly from the upper part, which is arranged in the cavity of the support pillar.

However, it has been found that the terrace canopy disclosed in BE 2014/0015 in certain weather conditions, for example at an excess of wind and/or precipitation, may collapse under the high loads.

EP 3 587 697 A1 discloses a terrace canopy constructed from columns and beams. In particular, the terrace canopy comprises a support pillar provided with a cavity for discharging precipitation incident on the terrace canopy towards a ground surface and at least two beams, each of which provided with an internal gutter for discharging precipitation incident on the terrace canopy to an end face of the beam. Headboards are used to connect the beams to the support pillar. In particular, a headboard is provided per beam that forms the end face of the front beam. In addition, an L-shaped corner piece is provided which serves as a corner connection between a column and the beams, the corner piece being fixedly attached to the headboards and to the top surface of the support pillar.

A drawback of the known L-shaped corner piece is the complex design required for the necessary functionality. First of all, several openings need to be made in the corner piece (on the one hand for the water drainage and on the other hand for cables). In addition, an upright wall is also required on the bottom surface for water drainage. A further drawback of the known L-shaped corner piece is that it is only suitable for connecting two corner-forming beams with a support pillar. However, connection points are also possible in a terrace canopy where more than two beams meet (e.g. T-connection with three beams or a cross connection with four beams) or where two beams meet in line with each other. The known L-shaped corner piece is not suitable for connecting such a node.

DESCRIPTION OF THE INVENTION

It is an object of the present invention to provide a terrace canopy with a simpler corner connection element.

This object is realized in that the corner connection element is provided with one, or preferably, several support legs extending towards the support pillar.

The support legs are a simple way to bridge the height difference between the connection of the corner connection element to the beams and the connection of the corner connection element to the support column, leaving passages open for water drainage. This height difference is typically present such that the gutter of the beam, in particular the internal gutter of the beam, may communicate with the support column. Due to the support legs, the corner connection element is therefore more simply formed than the known L-shaped corner piece, since no separate openings have to be made.

In an embodiment of the present invention, the gutter is an internal gutter and the corner connection element is provided with at least one passage, preferably at least two passages, wherein each passage connects a gutter of a beam with the cavity of the support pillar and wherein, preferably, each passage is provided between two support legs. This allows to drain precipitation incident on the terrace canopy to a ground surface via the beams and the support pillar without the need for externally visible drainage tubes. The passages are, preferably, formed between the support pillars such that, during manufacture of the corner connection element, no additional operations are required to make the passages.

In an embodiment of the present invention, at least one, and preferably each support leg is attached to the support pillar, in particular, to an upper surface of the support pillar. Preferably, this attachment is formed by means of connection means, such as bolts, extending through the entire support leg. Alternatively, it is also possible to attach at least one and preferably each support leg to a side surface of the support pillar. The use of the support legs for attachment to the support pillar is advantageous since the support legs then perform a dual function, namely attachment and bridging the height difference as already described above. Attaching the support legs to the top surface of the support pillar provides better force transfer between the support legs and the support pillar as compared to support legs attached to a side wall of the support pillar. Moreover, the connection means extending through the support legs allow for easy mounting as they can be fitted from the top of the corner connection element. In this way, it is also avoided that additional elements have to be placed between the support legs and the support pillar, in other words, there is a direct connection between them.

In an embodiment of the present invention, the corner connection element includes an upper part to which the headboards are fixedly attached, each support leg extending from the upper part to the support pillar. The upper part provides a solid interconnection between the beams, whereby the bearing loads are exerted onto the support pillar by means of the support legs.

In an advantageous embodiment of the present invention, the upper part of the corner connection element is substantially beam-shaped and has four side walls, wherein, from the corner points between the side walls, in each case one support leg extends from the beam-shaped part towards the support pillar. Alternatively or additionally, the top part of the corner connection element is provided with at least two side walls, each headboard being attached against a side wall of the corner connection element. Typically, each corner connection element will have a number of sides at least equal to the number of beams to be joined such that the different connections to the beams do not influence each other. Furthermore, the wall-to-wall mounting between the headboards and the corner connection element is advantageous because it results in a maximum contact surface for transmitting compressive forces, for example due to lateral wind loads. The beam-shaped upper part is advantageous because the same corner connection element can then be used for both a corner connection between two, three as well as four beams.

In an more advantageous embodiment of the present invention, each headboard is provided with at least one bolt opening, and the corner connection element is provided with a corresponding bolt opening in each side wall, which bolt openings are configured for the attachment of a headboard onto the corner connection element.

In a more advantageous embodiment of the present invention, each headboard is provided with at least one hook configured to hook onto an upper end of each side wall of the corner connection element for attaching a headboard to the first part.

These more advantageous embodiments make it possible to attach the headboards to the corner connection element in different ways or in several ways at the same time. The hooks are easy to use and can, for example, be used during installation to first hook the beams and then, without having to support them, attach them with the bolts.

In an embodiment of the present invention, each headboard is provided with a spout that connects to said gutter. The spout can serve to bridge the distance between the beam and the cavity in the column.

In an embodiment of the present invention the terrace canopy further comprises a drain, wherein the drain on its upper side is provided with at least one insertion cavity that is positioned in said passage. Preferably, said spout is at least partially received in said insertion cavity. If necessary, the insertion cavity can also bridge part or all of the distance between the beam and the cavity in the column. However, preferably, the insertion cavities are intended to at least partially receive a corresponding spout. This generally to avoid leaks in the drain extending through different elements.

In an advantageous embodiment of the present invention the terrace canopy further comprises a drain, wherein the drain comprises a downward tube positioned within the cavity of the support pillar. In this way, the risk of leakage is further reduced compared to the situation where the drain outputs on the cavity itself.

In an embodiment of the present invention, the corner connection element is integrally formed. An integrally formed corner connection element is preferred because of the higher rigidity and limitation of assembly work relative to a corner connection element consisting of multiple components.

In an embodiment of the present invention, each support leg is formed by a bar element, preferably a hollow bar element. A hollow bar element is advantageous as it allows attachment to the support pillar by means of attachment means extending through the support legs.

BRIEF DESCRIPTION OF THE DRAWINGS

The invention will hereinafter further be explained in detail with reference to the following description and to the accompanying drawings.

EMBODIMENTS OF THE INVENTION

Figure 1:
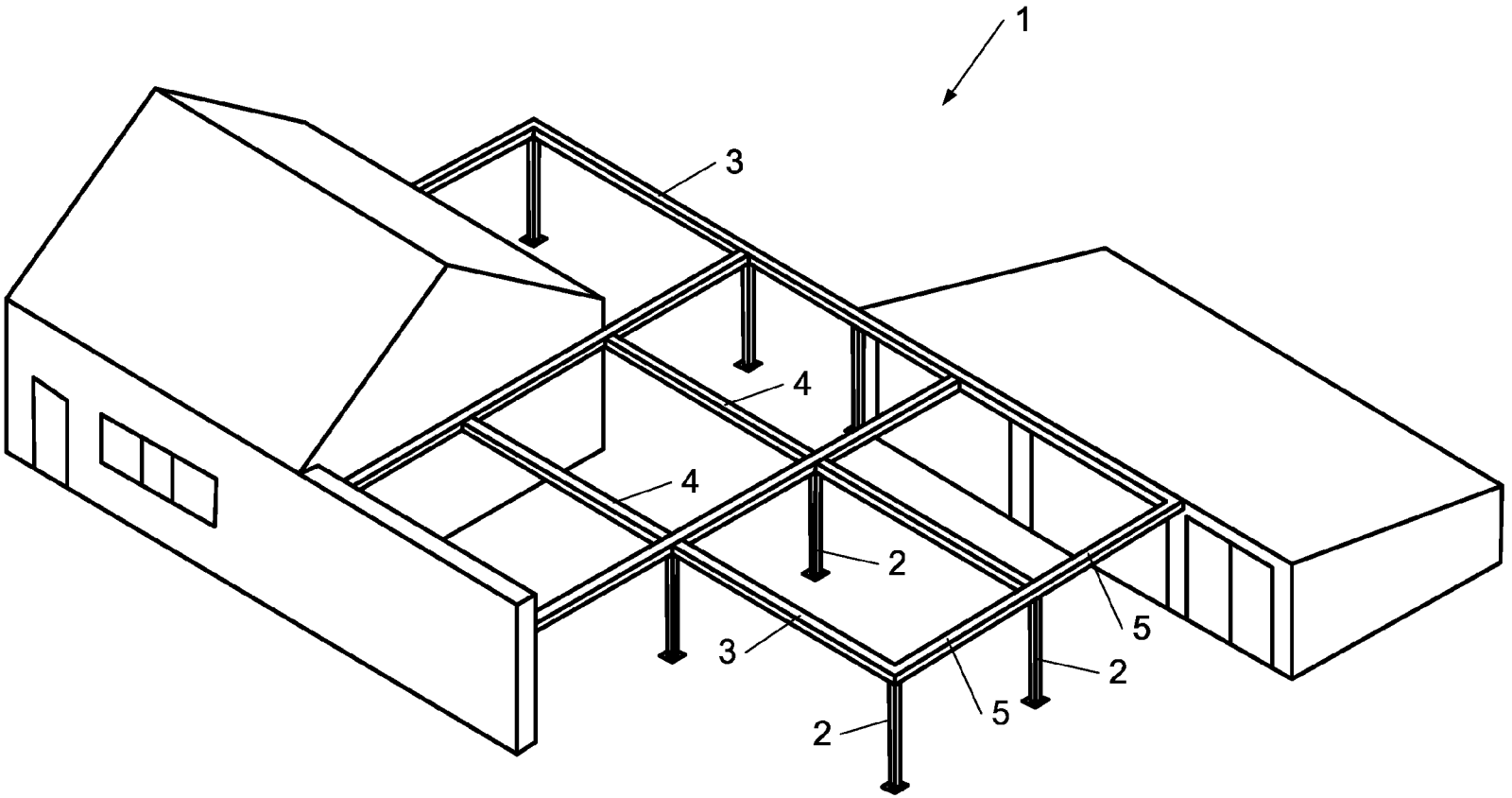
FIG. 1 shows a schematic view of a terrace canopy according to the invention.

The present invention will hereinafter be described using particular embodiments and with reference to certain drawings, but the invention is not limited thereto and is only defined by the claims. The drawings presented here are only schematic representations and are not limiting. In the drawings, the dimensions of certain components may be shown enlarged, which therefore means that the components in question are not shown to scale, and this for illustrative purposes only. The dimensions and relative dimensions do not necessarily correspond to the actual practical embodiments of the invention.

In addition, terms such as "first", "second", "third", and the like are used in the description and in the claims to distinguish between similar elements and not necessarily to indicate a sequential or chronological order. The terms in question are interchangeable under appropriate circumstances, and the embodiments of the invention may operate in other sequences than those described or illustrated herein.

The term "comprising" and derivative terms, as used in the claims, should not be construed as being limited to the means stated thereafter; the term does not exclude other elements or steps. The term should be interpreted as a specification of the mentioned properties, integers, steps, or components referenced, without excluding the presence or addition of one or more additional properties, integers, steps, or components, or groups thereof. The scope of an expression such as "a device comprising the means A and B" is therefore not limited only to devices consisting purely of components A and B. On the other hand, what is intended is that, for the purpose of the present invention, the only relevant components are A and B.

Figure 3:
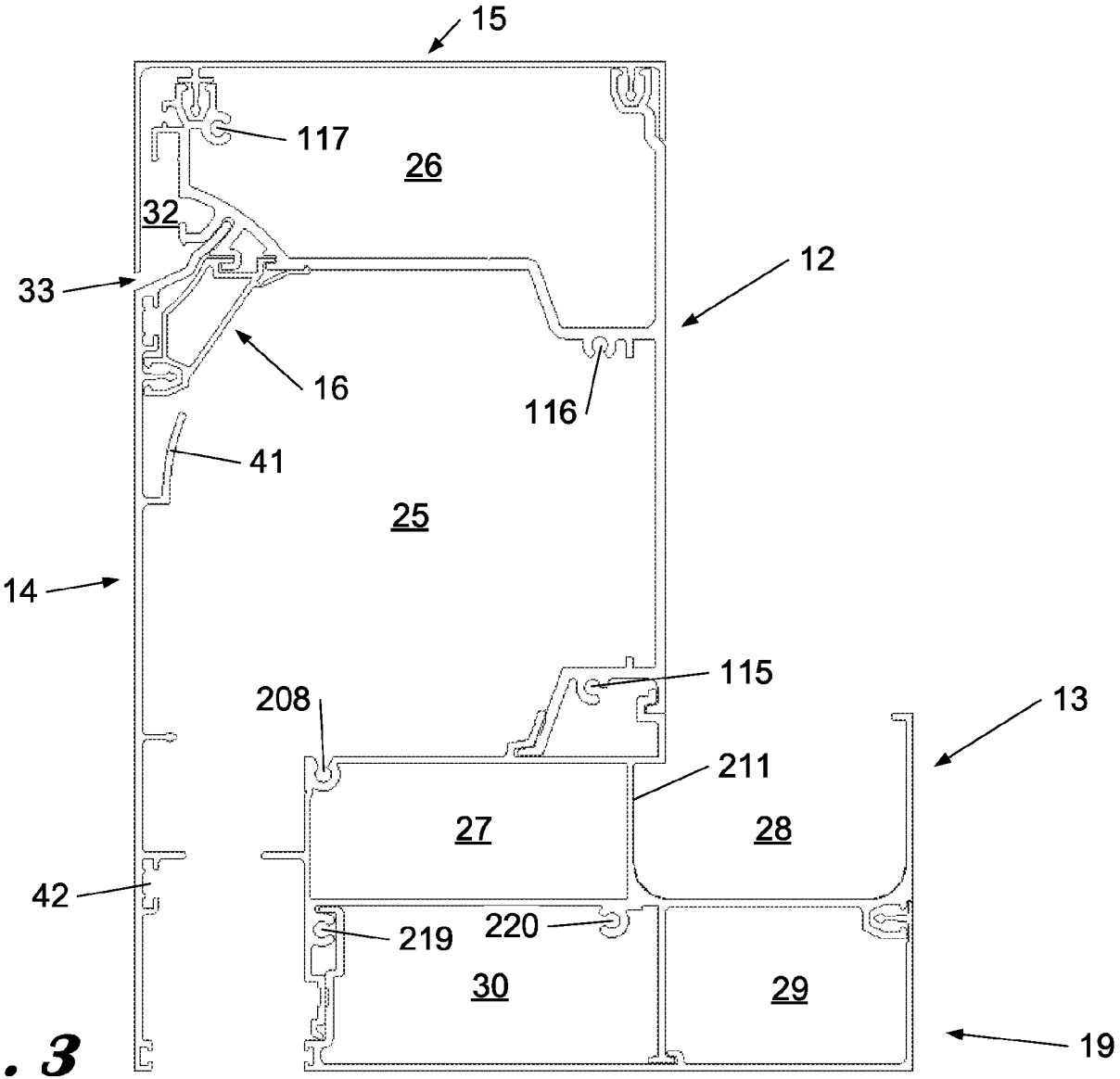
FIG. 3 shows a cross-section through the external pivot beam of the terrace canopy of FIG. 2.

With reference to FIG. 3, each reference to an orientation of the beams will be interpreted with reference to the position when mounted in the terrace canopy. In this way there are four orientations, namely above, below, outer side and inner side. Here, "above" refers to the part of the beam that is or will be oriented towards the top surface (the sky, e.g. the open sky), "below" refers to the part of the beam that is or will be oriented towards the ground plane (the soil, e.g. the terrace floor), "outer side" to the part of the beam that is or will be oriented away from the roof, i.e. away from the roof infill (i.e. the left side in FIG. 3) and "inner side" to the part of the beam that is or will be oriented towards the inner side of the roof, i.e. towards the roof infill (i.e. the right side in FIG. 3).

The term "substantially" includes variations of +/−10% or less, preferably +/−5% or less, more preferably +/−1% or less, and more preferably +/−0.1% or less, of the specified state, insofar as the variations are applicable to function in the disclosed invention. It is to be understood that the term "substantially A" is intended to also include "A".

FIG. 1 illustrates a terrace canopy 1 for a ground surface, for example a terrace or garden. The terrace canopy comprises a plurality of columns 2 that support different beams 3, 4, 5. The columns and beams together form frames to which wall infills 6 and/or roof coverings 7 can be attached, as described below. The terrace canopy 1 comprises three types of beams 3, 4, 5, namely:

- a beam 3 which, on the outside of the terrace canopy, serves as external pivot beam 3;
- a beam 4 which, centrally in the terrace canopy 1, serves as the central pivot beam 4; and
- a beam 5 which serves as a tension beam 5.

It will also be appreciated that the beams 3, 4, 5 may be attached to other structures, for example a wall or facade, instead of resting solely on columns 2 as shown in FIG. 1. In such a way, the terrace canopy 1 can generally be used to shield an outdoor space, as well as an indoor space.

Figure 2:
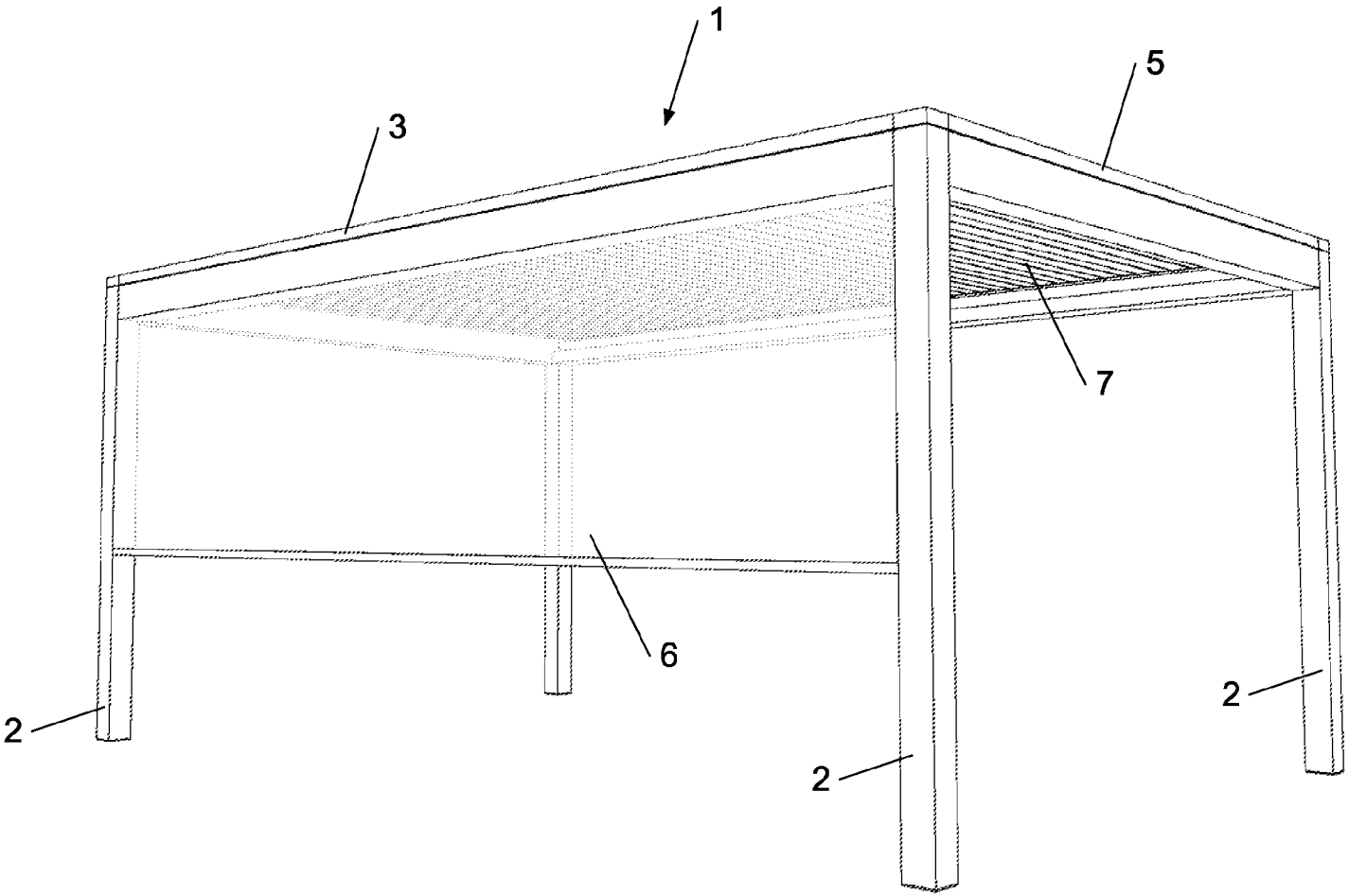
FIG. 2 shows an embodiment of the terrace canopy with a wall infill.

FIG. 2 shows a terrace canopy 1 with a wall infill 6. The terrace canopy 1 has four support columns 2 that support a frame, also called a roof frame. The frame is formed from two external pivot beams 3 and two tension beams 5 in between a roof covering 7 is provided.

In the embodiments shown, the roof covering 7 is formed by slats which are rotatably attached at their end faces to pivot beams 3. The slats are rotatable between an open position and a closed position. In the open position, there is an intermediate space between the slats through which, for example, air can be introduced into the underlying space or can leave this underlying space. In the closed position, the slats form a closed roof with which the underlying space can be shielded from, for example, wind and/or precipitation, such as rain, hail or snow. For the drainage of precipitation, the slats are typically arranged sloping towards one of both pivot beams 3.

The slats are typically manufactured of a rigid material. This can be aluminium, for example. Aluminium has many advantages as a material, as it is at the same time robust and light-weighted, it can withstand bad weather conditions and requires little maintenance. However, other materials are also suitable and their advantages or disadvantages are assumed to be known by the skilled person. A slat can be produced using various techniques depending on the material, including extrusion, cutting, setting, casting, welding, etc. The appropriate production technique is assumed to be known by the skilled person. Preferably, the slats are manufactured by means of an extrusion process. Optionally, filler elements of, for example, polycarbonate, glass, wood, etc. can be used to fill the hollow slats at least partially, for instance to obtain a different appearance of the slat.

Additionally, in an embodiment, in their open position, the slats may optionally be provided slidable in the terrace canopy 1, in order to further increase the control options in terms of incidence of light, radiant heat and ventilation.

More generally, the roof covering 7 is stationary or movable. A movable roof covering comprises, for example, tiltable and/or slidable slats (such as described above) and/or roll-in/roll-out screens and/or slidable panels. The individual elements of the movable roof covering 7 in their closed position form a substantially watertight roof with which the underlying space can be screened off from, for instance, wind and/or precipitation, such as rain, hail or snow. This roof covering 7 is typically drained to the pivot beams 3, 4 and from there directly or via the tension beams 5 to the columns 2. By sliding and/or rotating the slats and/or the panels and/or by rolling in a screen, the roof covering 7 can be at least partially opened and/or closed in order to be able to determine the incidence of light, radiant heat, ventilation, precipitation, etc. to the space below the roof covering 7 as desired.

Wall infills 6 are typically intended to screen openings below the terrace canopy 1 between the columns 2. The wall infills 6 can be stationary or movable. Movable side walls comprise, for example, roll-in/roll-out screens and/or wall elements that are slidably arranged with respect to each other, etc. Stationary side walls can be manufactured of various materials, such as plastic, glass, metal, textile, wood, etc. Combinations of different wall infills 6 are also possible.

FIG. 2 illustrates a wall infill in the form of a roll-in/roll-out screen 6. The screen 6 extends between two adjacent columns 2 and can be rolled out from the external pivot beam 3. The screen 6 mainly serves as a wind and/or sun screen.

In general, the beams 3, 4, 5 are constructed of one or more profiles such as described below. The profiles are typically manufactured of a rigid material. This can be aluminium, for example. Aluminium has many advantages as a profile material, as it is at the same time robust and light-weighted, it can withstand bad weather conditions and requires little maintenance. However, other materials are also suitable and their advantages or disadvantages are assumed to be known by the skilled person. A profile can be produced using various techniques depending on the material, including extrusion, cutting, setting, casting, welding, etc., with extrusion being the preferred technique. The appropriate production technique is assumed to be known by the skilled person.

Generally, the beams 3, 4, 5 of the terrace canopy 1 are hollow as shown in FIG. 3. The beams 3, 4, 5 are composed of a plurality of profiles. In what follows, the different profiles of the beams and their interconnection are briefly discussed. It goes without saying that several variants are conceivable for both the composition of the beams and the interconnection of the profiles, as well as that the specific design of the profiles may differ. In addition, it is also possible that the functionality of different profiles is combined into the same integrally manufactured profile, for instance it is possible to form the base profile 12 together with the external gutter profile 13 as an integrally formed core profile.

To form the beams 3, 4, 5, the profiles are connected to each other in a specific way. Generally, use is made of pin connections and/or hook connections. In a pin connection, an elastic element (not shown) is typically present in a female element, for example a slot element, into which a male element, for example a pin, engages. Hence, a pin connection generally includes an elastically interlocking male and female element, but an additional elastic element may be provided for this purpose, but this is not necessarily the case. The elasticity may also be provided from the design of the male and female elements. Hook connections typically involve two elements with such a design that they hook into each other. There is no elastic element and the connection is separated by moving the elements away from each other in the correct direction.

In addition, generally, for each interconnection of two profiles, use is made of two separate connections. This improves the rigidity of the connection, but mainly contributes to the correct mutual positioning of the profiles. The fact is that if only one connection is used for two profiles, there is more clearance in the mutual positioning, which can give rise to a divergent positioning, in particular due to wind loads and/or precipitation loads.

FIG. 3 shows a cross-section through the external pivot beam 3 of the terrace canopy of FIG. 2. The external pivot beam 3 is intended to be placed on the outside of the terrace canopy 1 and must provide water drainage from precipitation incident on the terrace canopy. In particular, this precipitation may, for example, be collected by a slatted roof 7 which drains precipitation to this pivot beam 3. The roof infill 7 drains the precipitation to the pivot beam 3 where it is collected in the external gutter 28. Between the external gutter 28 and the cavity 27 the intermediate wall 211 is present which is provided with one or more openings, for example a series of perforations, such that the precipitation from the external gutter 28 is diverted to the cavity 27. That is why the bottom of the external gutter 28 also preferably slopes towards the cavity 27. The cavity 27 serves as an internal gutter for the passage of precipitation from one or more adjoining pivot beams 3 to a column 2 along which this precipitation may leave the terrace canopy 1, as described below.

The pivot beam 3 is composed of a number of profiles, namely a base profile 12, a double gutter profile 13, a front cover 14, a cover profile 15, a connection profile 16 and an end profile 19. A screen cavity 25 is formed by the base profile 12, the double gutter profile 13 and the front cover 14. The screen cavity 25 is intended to hold a screen 6 that can be rolled in and out, which serves as a side wall of the terrace canopy 1, as shown in FIG. 2. The cover profile 15 serves to close a technical area 26 in the external pivot beam 3. This technical space 26 may serve for housing drive means for tilting the slats of the roof covering 7 and/or cabling for, for example, lightning, etc. The front cover 14 and the cover profile 15 are both removable. As a result, the screen cavity 25 and the technical room 26 are accessible such that modifications, adjustments and/or repairs may be made, if necessary.

The front cover 14 typically forms the outer side of the external pivot beam 3 and is attached to the base profile 12 through a connection profile 16. In the embodiments shown, the front cover 14 is further provided with a reinforcing rib 41 and a slot 42. The reinforcing rib 41 contributes to the rigidity of the front cover 14 and is useful for obtaining the required resistance at higher loads, especially when bridging relatively long lengths. The slot 42 is provided for arranging therein a holder (not shown) which serves as a abutment for the screen 6 when it is being rolled-up. Alternatively, the slot 42 or another wall may serve as such a screen roll abutment.

The pivot beam 3 also comprises a space 32 between the cover section 15 and a portion of the base section 12. The double channel section 13 is also provided with spaces 29, 30 which are closed off with the aid of the generally U-shaped end profile 19.

Furthermore, the external pivot beam 3 is further provided with screw channels 115, 116, 117, 208, 219, 220 for screwing a headboard to an end of this beam 3 with the aid of screws or bolts for the purpose of connecting the beam with a column of the terrace canopy 1. Screw channel 115 is provided on the underside of the base profile 12; screw channel 116 is provided centrally in the base profile 12 in the screen cavity 25; screw channel 117 is provided at the top of the base profile 12 in the technical space 26; screw channel 208 is provided on the upper outer corner of the internal gutter 27; and the screw channels 219, 220 are provided below the internal gutter 27 on either side thereof. Of course, more or less screw channels are also possible and/or the placement thereof may differ.

The terrace canopy 1 of FIG. 2 also comprises two tension beams 5. A cross-section thereof is not shown as this is quite similar to the one of the pivot beam 3 with the main difference being the absence of an external gutter 28. In the tension beam 5 screw channels are also provided for screwing a headboard to an end of this beam 5 with the aid of screws or bolts for connecting the beam to a column of the terrace canopy 1. Preferably, the screw channels of the tension beam 5 have the same positioning as in the pivot beam 3.

Figure 4:
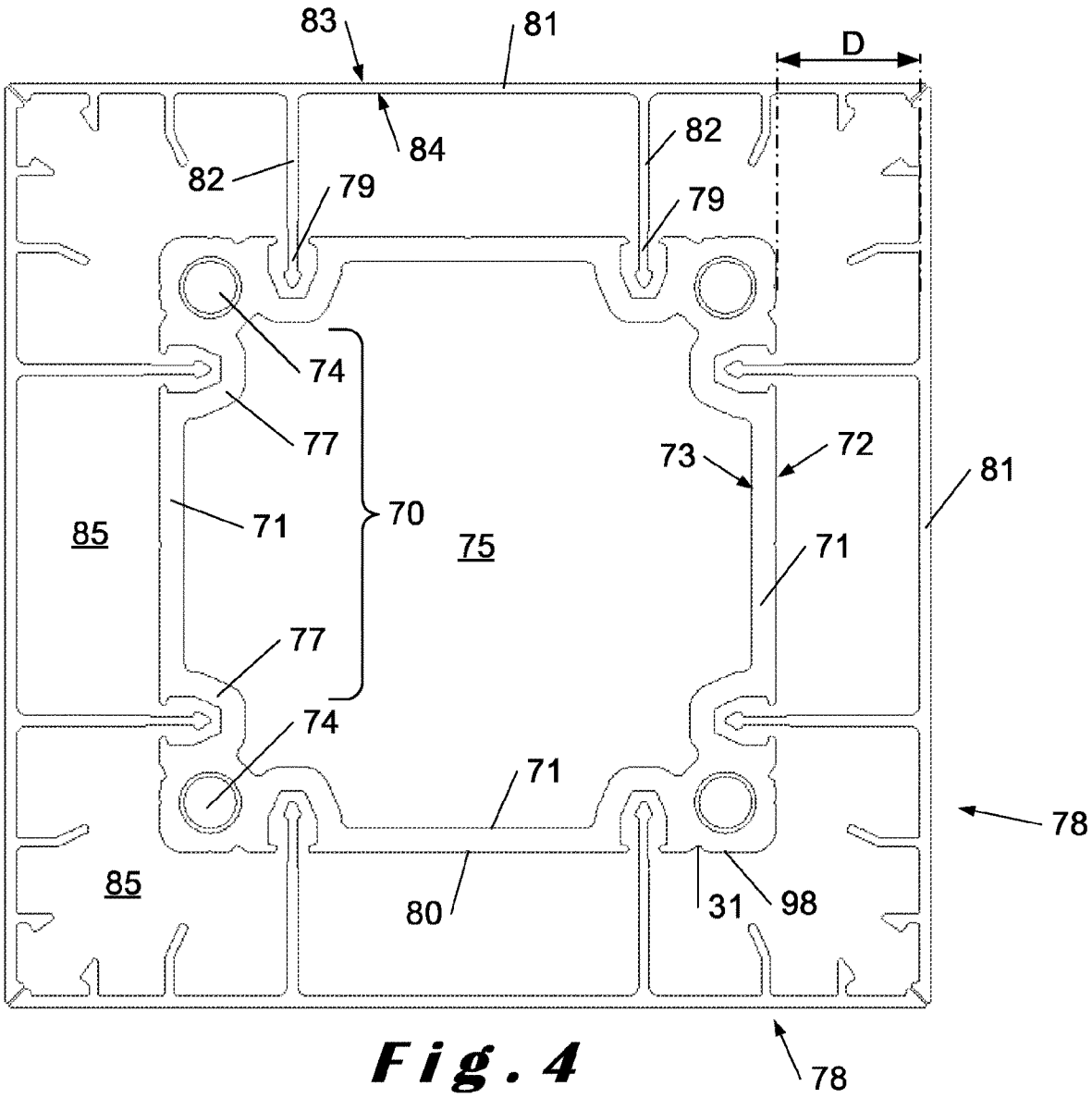
FIG. 4 shows a cross-section through the column of the terrace canopy of FIG. 2.

A cross-section through a column 2 of the terrace canopy 1 is shown in FIG. 4. The column 2 comprises an integrally formed core part (generally indicated by reference numeral 70). In particular, the core part 70 is formed by a profile of the same or similar type as the profiles of the beams 3, 4, 5. The profile 70 is typically manufactured of a rigid material. This can be aluminium, for example. Aluminium has many advantages as a profile material, namely, it is at the same time robust and light-weighted. However, other materials, such as steel, stainless steel, wood, plastic, etc., are also suitable and their advantages or disadvantages are assumed to be known by the skilled person. A profile can be produced using various techniques depending on the material, including extrusion, cutting, setting, casting, welding, etc., with extrusion being the preferred technique. The appropriate production technique is assumed to be known by the skilled person.

The profile 70 serves as a support pillar for the terrace canopy 1. In particular, almost the entire weight of the beams 3, 4, 5 and the elements connected therewith, such as the side walls 6 or the roof covering 7, is supported by the support pillar 70.

In the embodiments shown, the core profile 70 has a substantially square shape. Hence, each core profile 70 has four side walls 71, each having an outside 72 and an inside 73. Each outside 73 is provided with two mounting means 77, in particular mounting slots, preferably female pin connection means. These slots 77 serve for the attachment of finishing profiles 78 by means of a corresponding connecting means 79, preferably a pin. It should be understood that the pin connection 79 is only one example of a way of attaching the finishing profiles 78 to the core profile 70 and other ways are known to the skilled person. It should also be understood that the slots 77 need not necessarily be continuous, although this is preferred since the core portion 70 is preferably made by an extrusion process. The slots 77 are symmetrically positioned with respect to the centre of a side wall 71, such that the attachment points of a finishing profile 78 to the side wall 71 are also symmetrical, which is advantageous.

Although the use of two mounting means 77 per side wall 71 is preferred, in view of the fact that the use of two separate attachments between two profiles allows for less clearance in the mutual positioning, which clearance may give rise to a divergent positioning, in particular by wind loads and/or precipitation loads, a connection with only one mounting means per side wall is also possible. On the other hand, more than two mounting means may also be provided per side wall.

It should be understood that the core profile 70, as described above, is not limited to a substantially square shape. Also, the four side walls 71 can be arranged in a different geometric shape, for example a rectangle or parallelogram. In addition, it is also possible to provide more or less side walls 71 per core profile 70, in particular tri-, hexa- or octagonal core profiles 70 are also possible. Furthermore, the core profile 70 may also be elliptical, in particular circular, in which case the desired number of application slots is then provided in the one continuous side wall comprising the core profile 70.

The column 2 is further provided with four finishing profiles 78, namely one on each side wall 71. Each finishing profile 78 is provided with a flat outer wall 81, the outside 83 of which determines the visual appearance of the column 2. In other words, the finishing profile 78 hides the core profile 70 in the built-up terrace canopy 1. Furthermore, each finishing profile 78 is provided with pins 79, namely one pin per mounting slot 77. The pins 79 are connected to the outer wall 81 by means of walls 82 that serve as spacer. In particular, the length of the walls 82 determines the distance D between the outside 72 of a wall 71 and the inside 84 of the outside wall 81. By providing spacers 82, cavities 85 are also created. One or more of these cavities 85 may be used to integrate electrical cables that serve to drive the wall infill 6, the roof infill 7 and/or other electrically driven elements.

The connection of the support pillar 70 to the beams 3, 4, 5 will be described with reference to FIGS. 5 to 11.

Figure 5:
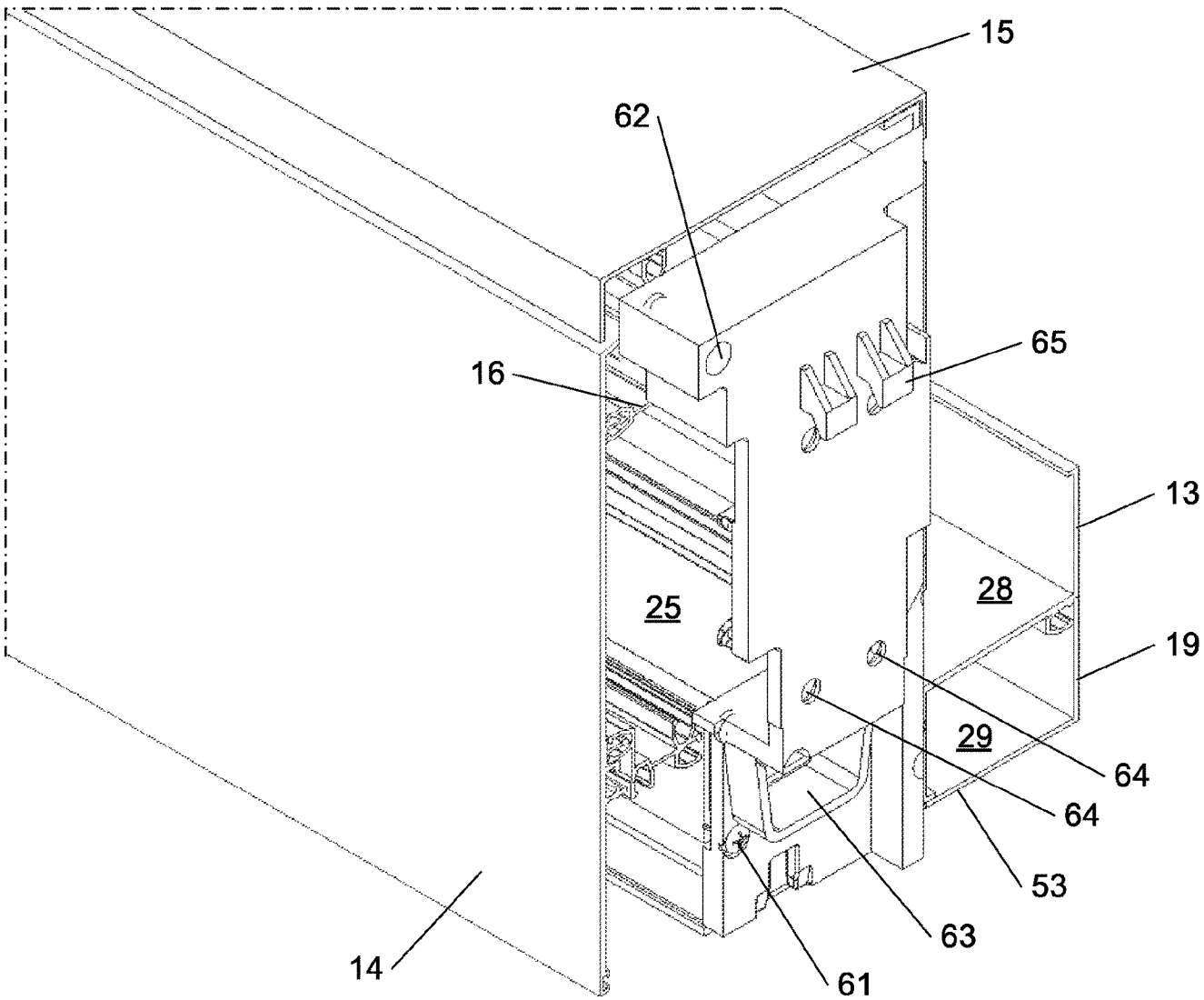
FIG. 5 shows a perspective view of the pivot beam of FIG. 3 with a headboard mounted thereon.

FIG. 5 shows the connection of a headboard 60 to the end of the external pivot beam 3 of FIG. 3. For this connection, the beams 3, 5 are provided with screw channels 115, 116, 117, 208, 219, 220, which are provided at the same location for each beam. In this way, the same headboard 60 can be connected with any embodiment of external pivot beam 3 and tension beam 5. Alternatively, it is of course also possible to provide different headboards 60 for different beams 3, 4, 5 if the placement of the screw channels varies.

Figure 6B:
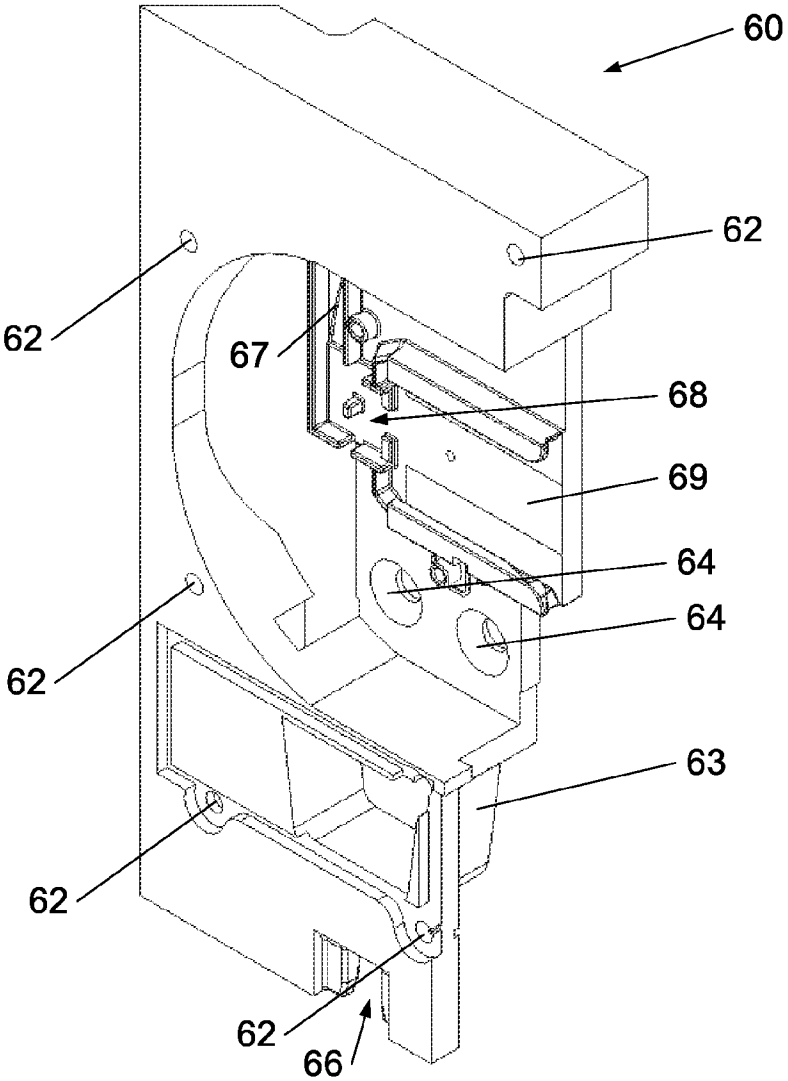
FIGS. 6A and 6B show a perspective view of the headboard of FIG. 5.
Figure 6A:
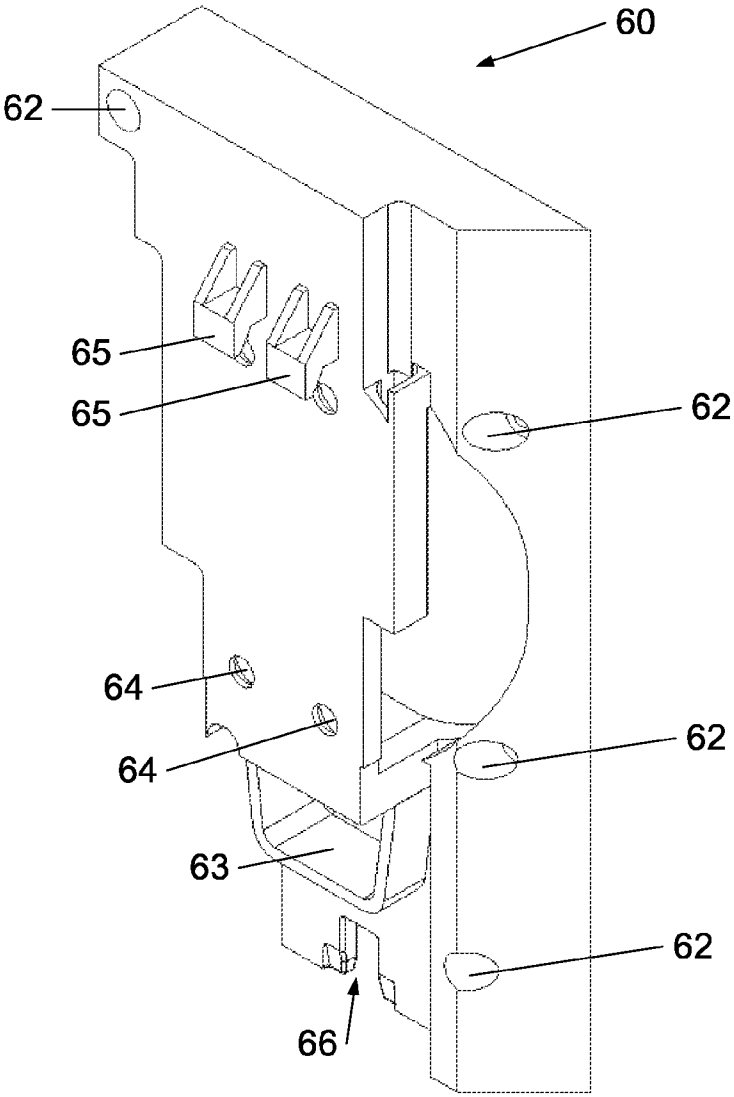

The headboard 60 for use with the beams 3, 5 is shown in more detail in FIGS. 6A and 6B. FIG. 6A shows the backside of the head board 60, i.e. the side which is directed away from the beams, after attachment. FIG. 6B shows the frontside of the head board 60, i.e. the side which is directed towards the beams after attachment.

Six openings 62 are provided in the headboard, corresponding in positioning to the screw channels 115, 116, 117, 208, 219, 220. This allows the headboard 60 to be attached by means of six bolts 61 passing through openings 62 to the beams 3, 5. It should be understood that more or less openings and screw channels can be used if desired. Although it is also possible to provide the screw channels in the headboard and to screw the bolts from the beams onto the headboard, the embodiment shown is preferred. This is because the headboard can be made more compact, in particular thinner, if no long screw channels need to be present.

As shown in FIG. 6A the headboard 60 is at its backside provided with four openings 64, and two hooks 65. These form each an alternative way to attach the headboard 60 to the column 2 as described below in more detail.

At the bottom side, the headboard 60 is provided with spout-shaped part 63 which connects to the central gutter 27 of the beams 3, 5. In this way, precipitation collected in the internal gutter 27 can leave it via spout 63. The external gutter 28 is provided with a closure (not shown) at its end face such that the precipitation collected in the external gutter 28 cannot but flow to the internal gutter 27. Also provided on the bottom wall of the headboard 60 is a recess 66 in which a clamping piece 34 can be placed as further described with reference to FIGS. 9A and 9B.

FIG. 6B also illustrates the provision of a plurality of containers at the frontside of the headboard. In particular, a cable duct 67 is provided in which an electricity cable can be provided. The cable duct 67 opens onto an electronics holder 68 in which the necessary electronics can be placed, for example for driving the screen 6. Along the electronics holder 68 a screen holder 69 is present in which one end of the screen roll can be placed.

Figure 7:
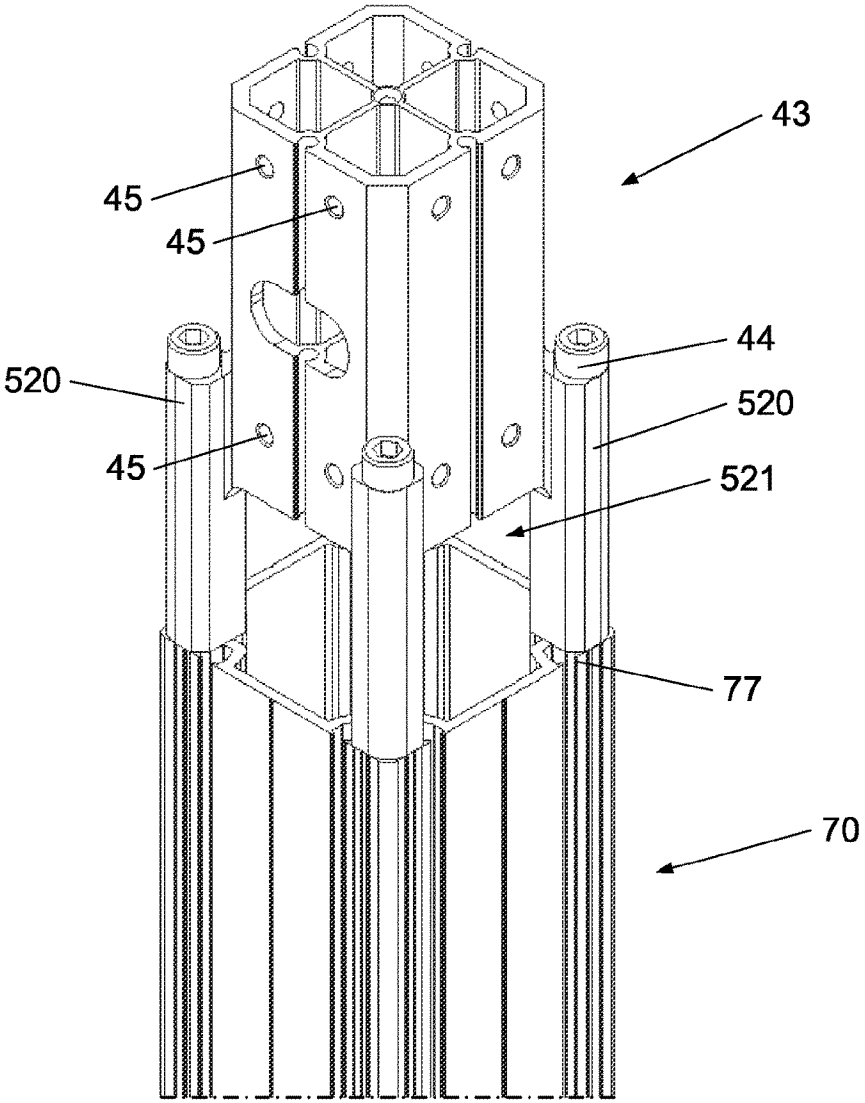
FIG. 7 shows a perspective view of the column of the terrace canopy of FIG. 2.
Figure 8:
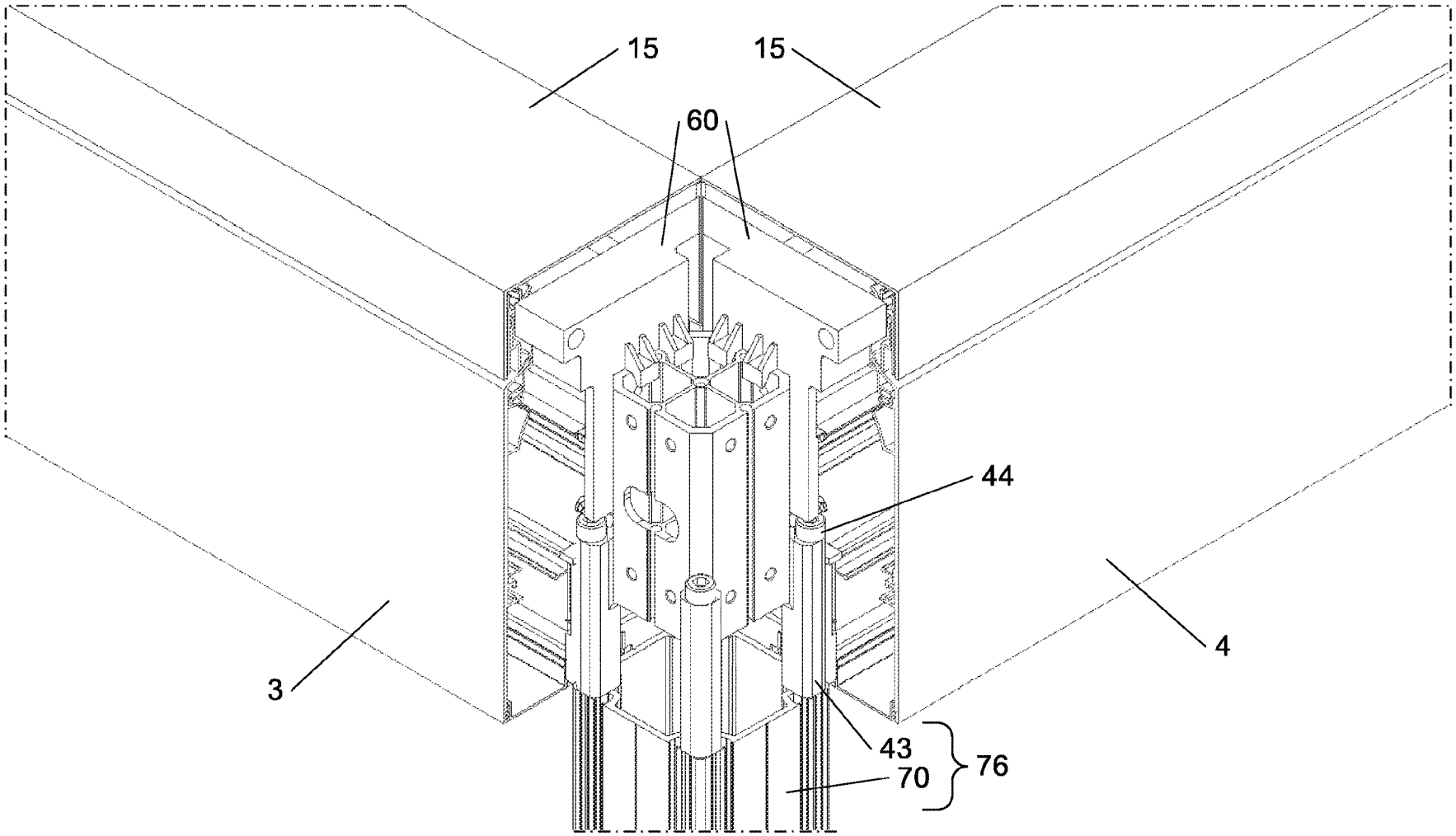
FIG. 8 shows a perspective view of the corner connection of two beams with a supporting column.
Figure 10:
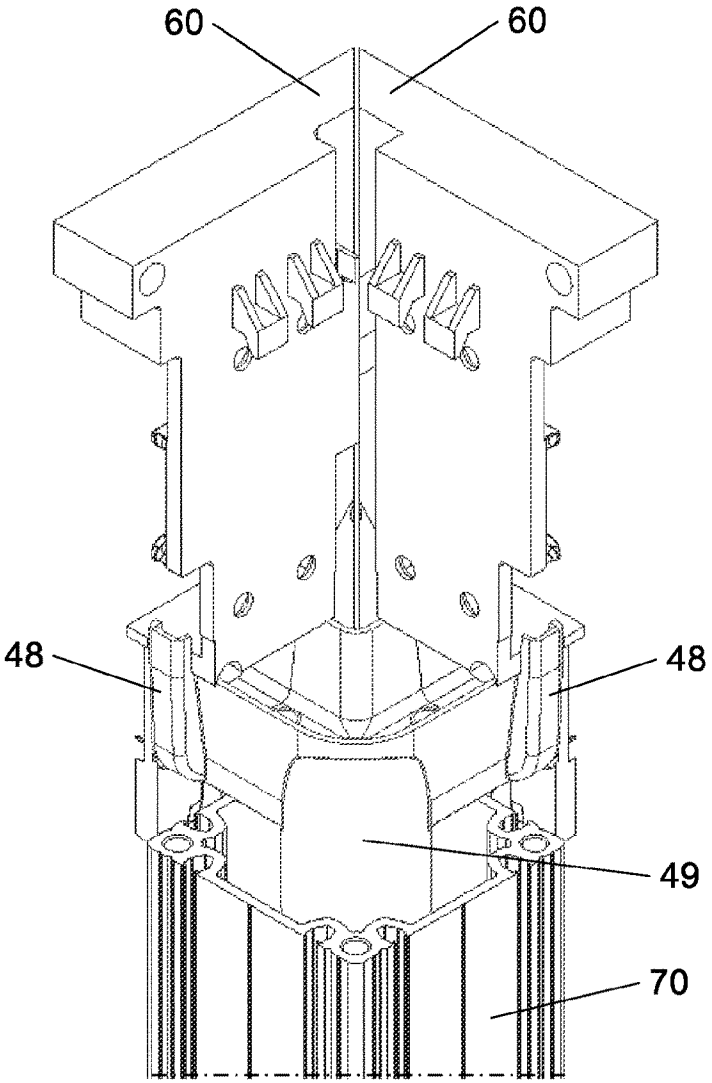
FIG. 10 shows the same perspective view as FIG. 8, with the beams removed and a water drain added.

FIG. 7 illustrates core profile 70 onto which a crown 43 is rigidly attached. In particular, the core profile 70 is provided on its topside with four openings 74 (see FIG. 4) which are suitable for receiving bolts or screws 44. Accordingly, the crown 43 is provided with four legs 520, in particular one leg 520 for each vertex of the crown 43. Between the legs 520, openings 521 are provided which serve as a passage for precipitation drainage. In particular, as described further, the spout portion 63 of a headboard 60 and/or an end 48 of the water drainage 46 fits into the passage 521. The legs 520 are hollow such that the bolts 44 can be threaded through the legs 520 onto the section 70 to allow to directly to attach the crown 71 to the profile 70 as shown in FIG. 10. As a result of this attachment, the profile 70 and the crown 43 together form the core 76 of the column 2 as indicated in FIG. 8. It is this core 76 that serves as a structural element, in particular as a support for the beams 3, 5. It should be understood that other connecting means are also possible to attach the legs 520 to the top of the support pillar 70, such as using an elongated rod and securing it by one or more transverse pins or by welding the components together. A threaded rod can also be used as connecting means, it being for instance provided fixedly on the topside of the profile 70 and over which the legs 520 are slid.

The crown 43 serves for the attachment of the beams 3, 5 to the column 2. For this purpose, the crown 43 is provided with openings 45 into which the bolts are screwed in order to fixedly connect the headboard 60 to the crown 43. Alternatively (or in addition) the topside of the crown 43 can be used to place the hooks 65 thereon to attach the headboard 60 to the topside of the crown 43. The hooks 65 are easy to use and may be used, for example, during installation to hook the beams 3, 5 first and then, without having to support them, to attach them with the bolts 66. The fastening with bolts 66 is more rigid and is preferred. In practice, both connections are used simultaneously. In this way, the headboards 60 together with the crown 43 actually form a corner connection between the beams 3, 5 and the support pillar 70.

Although this corner connection could be manufactured integrally, i.e. one integral element combining the functionality of the headboards and the crown, it is preferable to make a partition between the crown 43 and the headboards 60. First, this allows to change the design of the headboards 60 in function of the beam 3, 4, 5 (for example the other headboard needed for a central pivot beam 4) and still use only one crown 43. Furthermore, such an integrated corner connection is very difficult to be placed when three or four beams meet on the same support pillar 70.

The main advantage of the construction of column 2 is that the forces from the beams 3, 4, 5, for example by their weight or by wind load on a side wall that is attached to the beams 3, 4, 5, are directly transmitted to the core 76, in particular to the crown 43 thereof. In other words, although the headboards 60 are located between the beams 3, 4, 5 and the crown 43, they no longer serve as a support element to directly transfer the forces to the support pillar 70 forming the bottom side of the column 2.

Figure 9B:
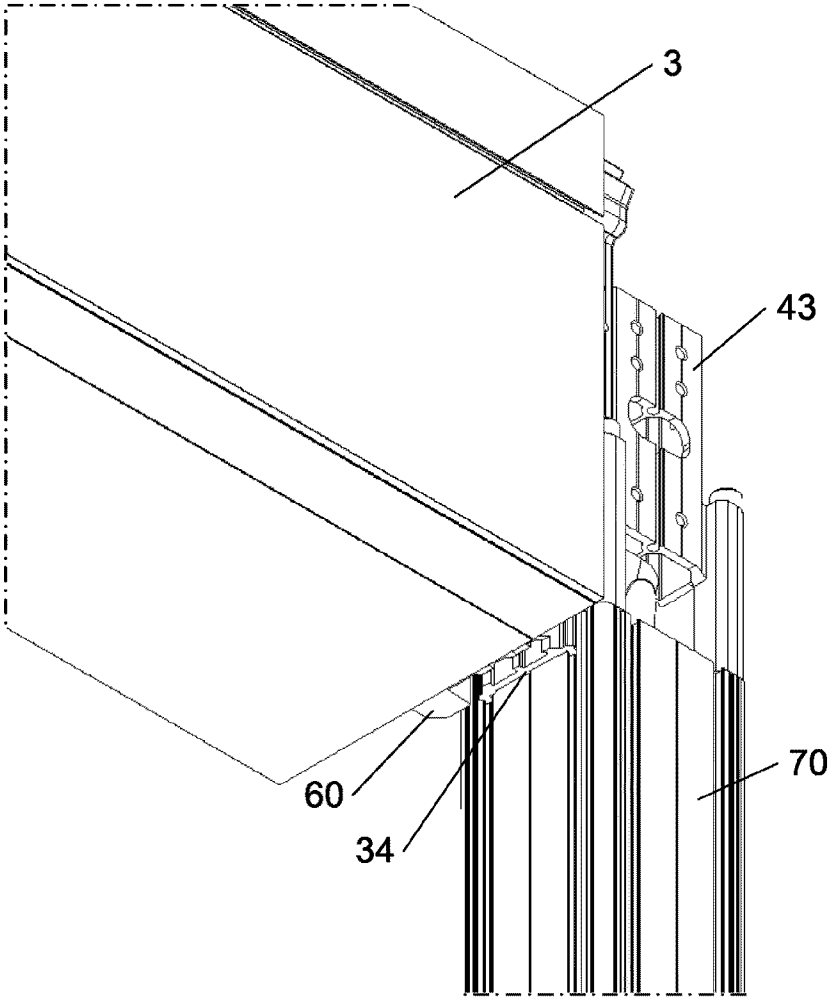
FIGS. 9A and 9B show more details about a tension piece for the connection between a beam and the column in the terrace canopy of FIG. 2.
Figure 9A:
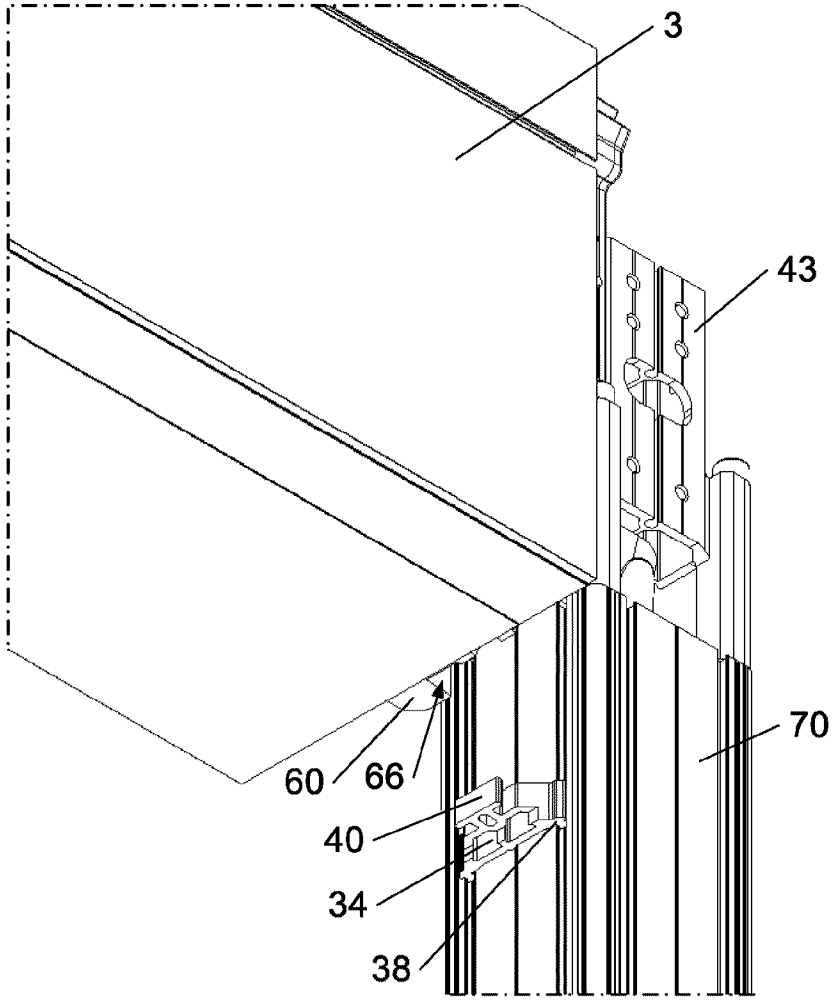

For further strengthening the connection between the beams 3, 4, 5 and the core 76 of the column 2, use can be made of a tension piece 4 as shown in FIGS. 9A and 9B. The tension piece 34 is provided on its one side with two connecting means, in particular pins 38, which fit into the mounting slots 77 provided on the side walls 71 of the core profile 70. On the opposite side, the tension piece 34 is provided with a connection means, in particular a tooth 40, which engages in the recess 66 provided on the underside of the headboard 60. By arranging this clamping piece 34, there is an additional connection between the beams 3, 4, 5 and the support pillar 70 of the column 2.

Figure 11:
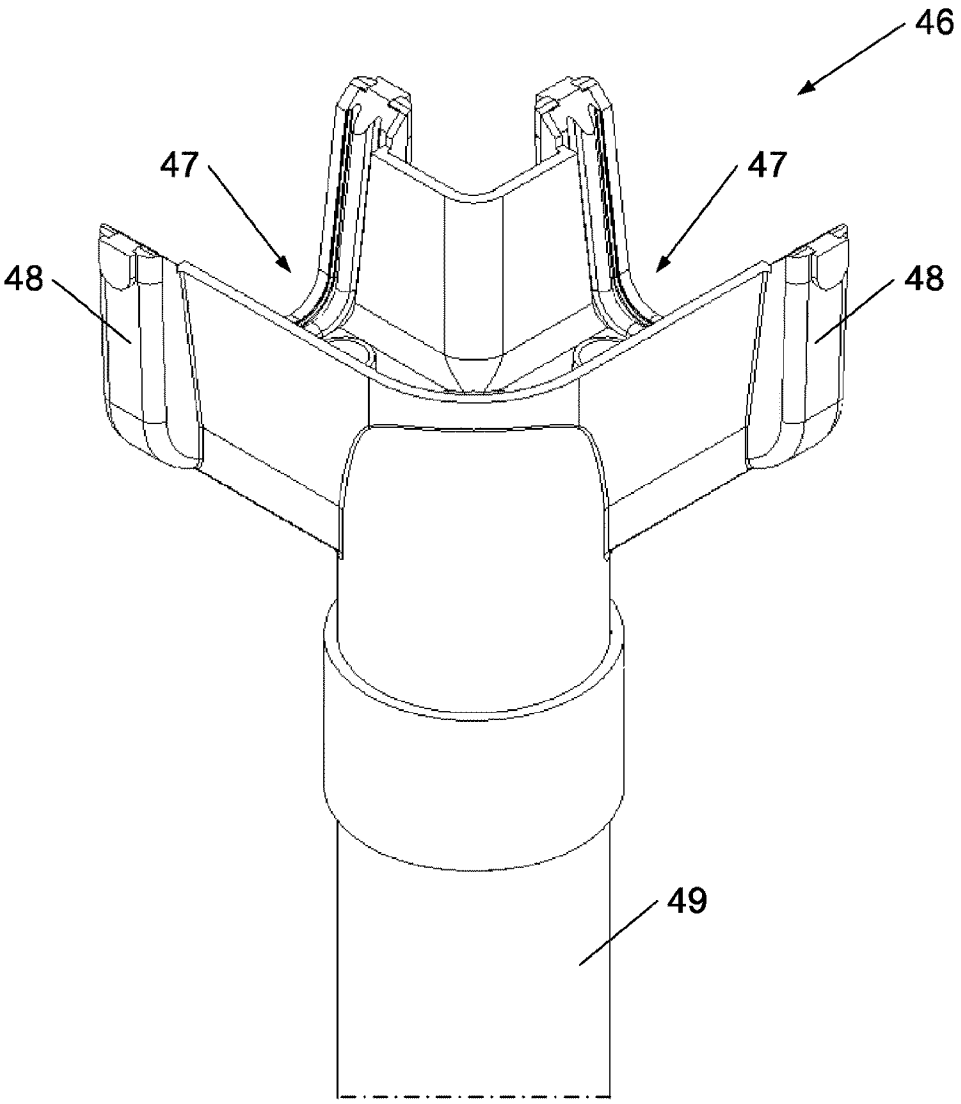
FIG. 11 shows a perspective view of the water drain of FIG. 10.

FIGS. 10 and 11 illustrate the precipitation drainage from the beams 3, 4, 5 to the column 2. The core profile 70 is hollow (see FIG. 4), which allow to provide a drainage 46 for precipitation. This cavity 75 can also be used to integrate electrical cables. Although the cavity 85 between profile 70 and finishing profiles 78 is preferably utilized for this purpose, since this is more easily accessible after mounting.

The drainage shown 46 is designed as a collecting cup which comprises at the topside two insertion cavities 47 formed by ends 48 (see FIG. 11). The spout 63 of a headboard 60 is fitted into a corresponding insertion cavity 47. The drain shown 46 is provided for the coupling of two beams 3, 4 in a corner which is supported by a column 2. A downward tube 49 is provided centrally in the drain 46 such that the supplied precipitation may be diverted to the bottom side of the column 2 where it can exit column 2 through an opening (not shown).

In view of the plurality of possible corner connections between the beams 3, 4, 5 of the terrace canopy (see FIG. 1), a plurality of different drainages 46 are possible. This may range from a simple corner drain as shown in FIGS. 10 and 11 to a central drain onto which four beams exit to a passage from one beam to the other where no downward tube 49 is present. Optionally, the downward tube 49 can also be omitted such that precipitation flows through the cavity 75 of the core profile 70.

In an embodiment, the terrace canopy 1 is constructed by performing the following steps. In a first phase, the headboards 60 are attached to the beams 3, 5. In particular on the base profile 12 and the gutter profile 13. At this stage, the crown 43 is also placed on the support pillar 70 such that the core 76 of the column is formed. Subsequently, the headboards 60 (with part of the beams 3, 5 already thereon) are hooked, via hooks 65, on the core 76, in particular on the crown 43. Since the front cover 14 has not yet been placed on the beam 3, 5, it is now possible to place bolts through openings 64 in the headboard 60 to screw it to the crown 43 via openings 45 therein. In the next phase, the screen roll can be placed in the beams 3, 5 and/or another type of wall infill and/or other internal components such as the roof covering 7, the tension piece 34, etc. After the installation of all internal components, typically the front cover 14 and/or the cover profile 15 and/or the end profile 19 is placed for finishing.

While certain aspects of the present invention have been described with respect to specific embodiments, it is understood that these aspects may be implemented in other forms within the scope as defined by the claims.

The invention claimed is:

1. A terrace canopy comprising:

a support pillar provided with a cavity for discharging precipitation incident on the terrace canopy toward a ground surface;

at least two beams, each of which provided with a gutter for discharging precipitation incident on the terrace canopy to an end face of the beam;

a first headboard fixedly attached to the end face of a first of the at least two beams;

a second headboard fixedly attached to the end face of a second of the at least two beams; and a corner connection element fixedly attached to the support pillar, the first headboard, and the second headboard, wherein the corner connection element is provided with one or more support legs extending toward the support pillar.

2. The terrace canopy according to claim 1, wherein the corner connection element comprises an upper part to which the at least one headboard is fixedly attached, wherein each support leg extends from the upper part to the support pillar.

3. The terrace canopy according to claim 2, wherein the upper part of the corner connection element is substantially beam-shaped and has four side walls, wherein, from the vertices between the side walls, in each case extends a support leg from the beam-shaped part towards the support pillar.

4. The terrace canopy according to claim 2, wherein the upper part of the corner connection element is provided with at least two side walls, wherein each headboard is attached against a side wall of the corner connection element.

5. The terrace canopy according to claim 4, wherein each headboard is provided with at least one bolt opening and in that the corner connection element is provided with a corresponding bolt opening in each side wall, which bolt openings are configured for attaching a headboard to the corner connection element.

6. The terrace canopy according to claim 4, wherein each headboard is provided with at least one hook that is configured to latch onto an upper end of each side wall of the corner connection element for the attachment of a headboard onto a first part.

7. The terrace canopy according to claim 1, wherein at least one of the one of more support legs is fixedly attached to the support pillar.

8. The terrace canopy according to claim 7, wherein each support leg is fixedly attached to an upper surface of the support pillar by means of connection means, such as bolts, extending through the entire support leg.

9. The terrace canopy according to claim 7, wherein the one support leg is fixedly attached to a side surface of the support pillar.

10. The terrace canopy according to claim 1, wherein the corner connection element is integrally formed.

11. The terrace canopy according to claim 1, wherein each support leg is formed by a rod element.

12. The terrace canopy according to claim 1, wherein the gutter is an internal gutter, wherein the corner connection element is provided with at least one passage, and wherein each passage connects a gutter of a beam with the cavity of the support pillar.

13. The terrace canopy according to claim 1, wherein the terrace canopy further comprises a drain, which drain comprises a downward tube positioned within the cavity of the support pillar.

14. The terrace canopy according to claim 13, wherein the gutter is an internal gutter and in that provided with the corner connection element is provided with at least one passage, wherein each passage connects a gutter of a beam with the cavity of the support pillar, and wherein the drainage is provided at its upper side with at least one insertion cavity positioned is in the passage.

15. The terrace canopy according to claim 14, wherein each headboard is provided with a spout that connects to the gutter and in that the spout is at least partially received in the insertion cavity.

16. The terrace canopy according to claim 3, wherein the upper part of the corner connection element is provided with at least two side walls, wherein each headboard is attached against a side wall of the corner connection element.

17. The terrace canopy according to claim 5, wherein each headboard is provided with at least one hook that is configured to latch onto an upper end of each side wall of the corner connection element for the attachment of a headboard onto a first part.

18. The terrace canopy according to claim 1, wherein each support leg is fixedly attached to an upper surface of the support pillar.

19. The terrace canopy according to claim 11, wherein the rod element is a hollow rod element.

20. The terrace canopy according to claim 12, wherein each passage is provided between two support legs.

* * * * *